United States Patent [19]

Radomsky

[11] Patent Number: 4,957,434

[45] Date of Patent: Sep. 18, 1990

[54] METHOD AND APPARATUS FOR TREATING ASPHALTIC CONCRETE PAVING MATERIALS

[75] Inventor: John Radomsky, Cedar Park, Tex.

[73] Assignee: Cyclean, Georgetown, Tex.

[21] Appl. No.: 811,364

[22] Filed: Dec. 20, 1985

[51] Int. Cl.[5] ..... F27B 7/36

[52] U.S. Cl. ..... 432/103; 432/105; 110/220; 34/1; 366/4; 366/25; 219/10.55 R

[58] Field of Search ..... 432/103, 105, 14; 34/1.4; 219/10.55 R, 10.55 A, 10.55 M; 366/23, 25, 4

[56] References Cited

U.S. PATENT DOCUMENTS

| | | | |
|---|---|---|---|
| 3,951,081 | 4/1976 | Martin et al. | 110/220 |
| 4,242,220 | 12/1980 | Sato | 34/1 |
| 4,319,856 | 3/1982 | Jeppson | 219/10.55 R |
| 4,398,826 | 8/1983 | Mendehall | 366/25 |
| 4,411,530 | 10/1983 | Low et al. | 366/4 |
| 4,427,376 | 1/1984 | Etnyre et al. | 432/105 |
| 4,481,039 | 11/1984 | Mendehall | 366/4 |
| 4,504,149 | 3/1985 | Mendehall | 432/105 |
| 4,571,860 | 2/1986 | Long | 34/1 |

*Primary Examiner*—Henry C. Yuen
*Attorney, Agent, or Firm*—Ronald R. Snider

[57] ABSTRACT

A method of heating reclaimed asphalt paving is shown and described. An air sorter removes fine materials from the reclaimed asphalt paving, and an air circulating dryer which utilizes high velocity air impingement, removes the moisture from the material. A conventional combustion heating tunnel is used to raise the temperature of the material to a first desired temperature and a microwave heating tunnel is used to raise the temperature to a final desired temperature.

33 Claims, 2 Drawing Sheets

METHOD AND APPARATUS FOR TREATING ASPHALTIC CONCRETE PAVING MATERIALS

BACKGROUND OF THE INVENTION

1. Field of the Invention

This invention relates to the field of treating asphaltic concrete paving materials and the recycling of said materials. It is necessary to perform the recycling of the paving materials at the least cost per ton of material. The use of hot air or high heat combustion gases to heat asphaltic paving materials and the use of microwave fields is well known in the art.

The single greatest cause of inefficiency in heating asphaltic paving is the necessity for driving off water vapor. Until such water vapor is driven off and removed from the paving materials, the materials cannot be heated to their ideal working temperature which is well in excess of the boiling temperature of water.

In the prior art little concern has been given to efficient heat transfer, heat utilization, and to prevention of degradation of the asphalt while maintaining overall efficiency.

2. Brief Summary of the Invention

This invention is a method of treating a reclaimed asphaltic concrete paving material which utilizes as its first step the removal of loose fines (small particles)from the reclaimed asphalt paving (RAP). Strictly speaking, we are not removing all fines from the RAP. These are loose fines. There is a substantial portion of fines in the RAP which is bound up by the asphalt and contained in the larger agglomerates of RAP. These agglomerated fines are dry and are needed in the final mix. It has been found that the moisture in the RAP is on the surface of the particles of the material The small particles have a far greater surface area to volume ratio than the larger particles. The small particles have on their surfaces, the larger portion of the water in the RAP. Therefore, if the fine materials are removed prior to the heating of the RAP, a substantial savings in energy input may be achieved. It is also true that an excess of fines in the mix is unacceptable because it will not meet specifications for gradient of material.

In this invention, an air sorter and/or screens are used to separate out fine materials which are less than a predetermined size. The materials which are greater than the predetermined size (remaining RAP) are then first heated in a recirculating air dryer to a first predetermined temperature. The RAP at the first predetermined temperature is then heated to a higher predetermined temperature required for working the asphaltic pavement in a microwave tunnel. By the use of these three steps, substantial energy savings are achieved by first, eliminating substantial quantities of water through the removal of fines by the air sorter, secondly, by heating the RAP to a first predetermined temperature in a recirculating air dryer which is very efficient. Still further, efficiencies are achieved by the use of the microwave radiation tunnel which allows heating of the RAP without overheating the asphaltic components. Overheating causes smoking and inefficient use of the available heat and degradation of asphalt.

In another embodiment of this invention, the RAP is separated into a plurality of sizes, and each of the sizes is then heated in a separate conveying and heating apparatus. By separating into groups of different sizes, different heating rates or methods may be applied to each group, thereby eliminating the problem of overheating small particles and underheating larger particles. Through particle separation, better control over the asphaltic pavement recycling operation is achieved.

The microwave heater in accordance with this invention may comprise an aluminum or stainless steel enclosed microwave heating tunnel in combination with a stainless steel conveying belt. Still further, the microwave tunnel may provide for placement of the microwave antenna within three inches or less of the RAP which is being treated. Arcing and undesirable dust clouds can be kept to a minimum in the region of the microwave heating element by placement of a dust shield between the microwave antenna and the RAP passing through said tunnel. The dust shield may be fiberglass cloth or other suitable fabric which is transparent to the microwave.

DETAILED DESCRIPTION OF THE PREFERRED EMBODIMENT

Figure 1:
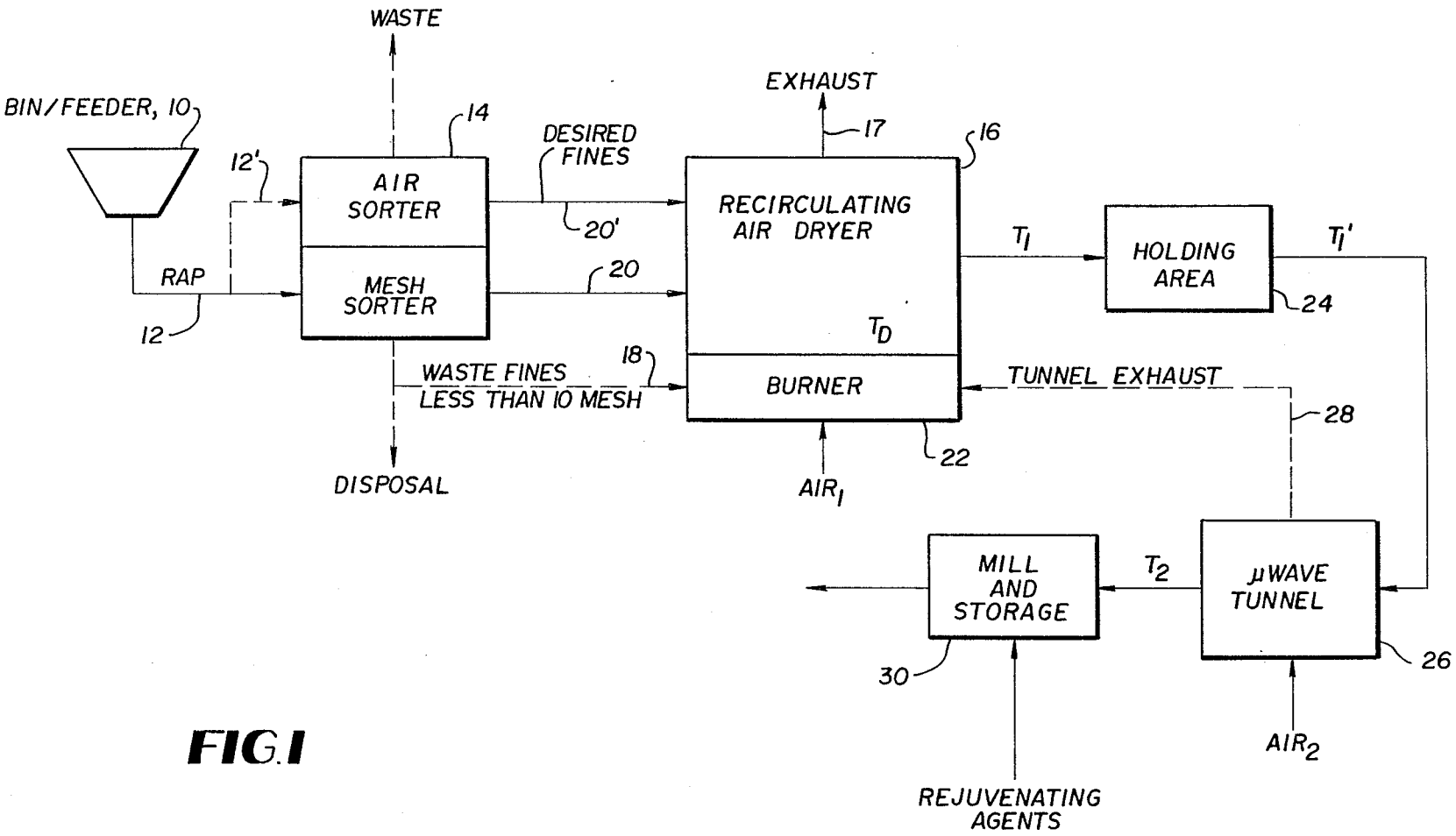
FIG. 1 shows in diagrammatic form the various steps of the method of this invention.

FIG. 1 is a diagram showing an apparatus lay-out for practicing the method of this invention. The reclaimed asphalt paving (RAP) is first placed in a bin feeder (10) which supplies RAP to a conveyor 12. The conveyor 12 may be a reciprocating plate type, or a belt conveyor. The RAP is fed to air sorter 14 where the smaller particles in the RAP are separated out by the application of high pressure air. The size of particle sorted is selected according to specific job needs. The air velocity may be in the order at 100 mph, and in accordance with this convention, the sorter separates out waste fines which are less than 10 mesh from the RAP. The fines that are removed may be collected in cleaner bags and disposed of, or may be collected and used in conjunction with the fuel supply for the burner of the recirculating air dryer 16. In FIG. 1, the use of the waste fines is depicted by dashed line 18 from the sorter 14 to the recirculating air dryer burner 22. The conveyor section 20 carries the RAP which has a size greater than 10 mesh from the air sorter 14 to the recirculating dryer 16. The conveyor belt 20 may be a rubber or stainless steel conveyor belt, however, the material is not critical here. Conveyor section 20 refers to the case where air sorting is before mesh sorting. Conveyor section 20' shows the path of the desired fines where they are first mesh sorted and then air sorted.

After the RAP has passed through the air sorter 14, it may be further sorted by the use of a conventional mesh sorter in order to provide further breakdown of the RAP material in accordance with size. In the embodiment depicted graphically in FIG. 3, it is shown $+\frac{3}{8}$, $\frac{3}{8}-\frac{1}{8}$, and $-\frac{1}{8}$ material which is fed into three separate conveying belts, 42, 44, and 46. The mesh sorter may be incorporated into the sorter 14. In practice, the separation of the fines can be accomplished either before or after the screening. In some applications, it may be better to screen first and then use air sorter on only the finer material. This is shown in FIG. 1 as the dashed line 12'.

Figure 4:
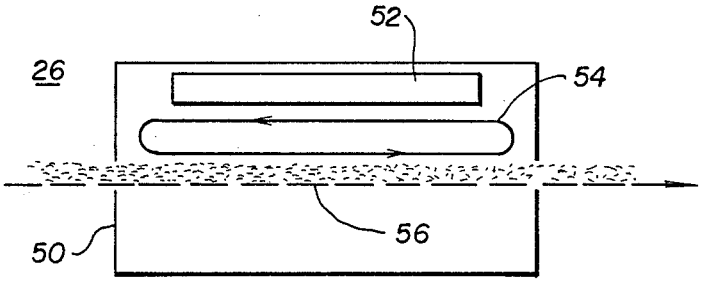
FIG. 4 shows a schematic representation of a microwave heating tunnel and conveyor system.
Figure 5:
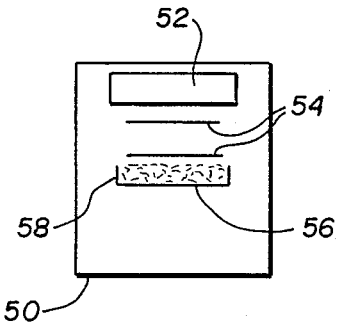
FIG. 5 shows a schematic representation of the end-view of the microwave tunnel.

FIG. 5 shows an end view of the microwave heating tunnel 26 as set forth in FIG. 4.

The recirculating air dryer 16 includes a burner 22 which supplies heat. In operation, the recirculating air dryer recirculates hot air from the drying region, where the RAP is located, back to the burner. In this way, heat contained in the drying air is not lost to the process. A portion of the recirculating gases in the dryer are exhausted (17) during each cycle, and additional fresh air ($Air_1$) is added during each cycle. The additional fresh air is supplied in the amount necessary to provide oxygen to the burner.

Figure 3:
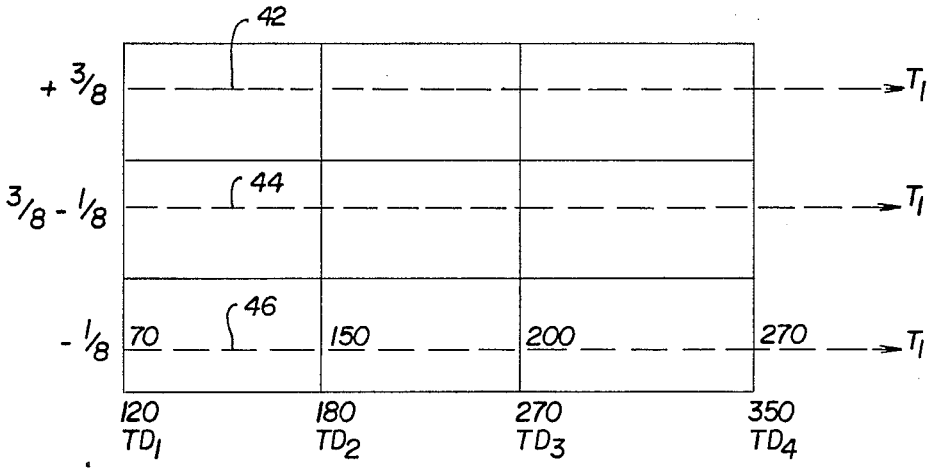
FIG. 3 shows in schematic form a plurality of conveying systems, each containing different sized RAP, and wherein heat is applied in progressive steps to the conveyed RAP.

If a plurality of belts of sized material is used as generally indicated in FIG. 3, the air dryer may be separated into three separate air drying units, each capable of providing the appropriate amount of heat and air velocities for raising the temperature of the previously sized material passing through it.

Additional efficiency may be realized in the air dryer in accordance with the methods schematically set forth at FIG. 3. Here, high temperature gases (350°) are applied to the exit portion of the RAP material passing through the feeding tunnel. The top (input) temperature chosen for the hottest gases is selected as the highest temperature which the RAP stream being treated will take without smoking. In the region denoted, III, the gas temperature is lowered from the initial temperature $T_{d1}$ which may be 350° to $T_{d2}$ which may be 290°. Likewise, in region II, the gas temperatures are further lowered from $T_{d2}$ to $T_{d3}$ which may be in the order of 320°. Finally, in region I, the gas temperature is reduced from 220° to 170° or $T_{d4}$. As the RAP passes into the tunnel, it may be at an ambient temperature of 70°, and after passing through region I it may reach a temperature of 150°. After passing through region II, the temperature may reach 200°. After passing through the region III, the RAP may reach a temperature as great as 270°. In this manner, the higher heat $T_{d1}$ is applied to the hottest RAP passing through the tunnel, and the cooler gases are applied to the lower temperatured RAP. A substantially large amount of heat may be removed from the heating gases prior to their recirculation as compared to a single stage heater where the gases are inserted at 350° and removed after they make a single pass across the RAP. In such single pass systems, the exit temperature is substantially greater than $T_{d4}$, because the tunnel length and passage time for the material are small.

The RAP, when inside the recirculating air dryer experiences rapid drying due to the high heat of the recirculating air (350°–450° F.), and also drying due to the high velocity (impingement) of the gases within the recirculating air dryer. The gas is applied at right angles to the material bed through slits or pipes or other means of producing high velocity local air streams inside the dryer compartment. A high speed air stream applied parallel to the material will have far less heating effect. The velocity of this gas may be on the order of 100 mph. The high velocity of the continuous convection within the recirculating air dryer removes the water from the surface of the RAP within the dryer. Since this removal is rapid, the pieces of RAP will be heated to a higher temperature at their surface than at their interior.

It is desirable to raise the temperature of the RAP as high as possible while it is in the recirculating air dryer. The limit on the achievable temperature is determined by the temperature at which the RAP begins to smoke and where the heat causes degradation of bituminous materials in the RAP. It has been found that the RAP can be raised to a temperature of approximately 220° (Temperature $T_1$, FIG. 1) without causing undue smoking and/or burning. The temperature of the dryer air $T_d$ may be in the order of 350°–400° F., but since the application to the RAP is rapid, the actual RAP temperature is not raised above $T_1$.

The conveyor within the recirculating air dryer may be a typical conveyor belt, and may be of rubber or stainless steel.

Figure 2:
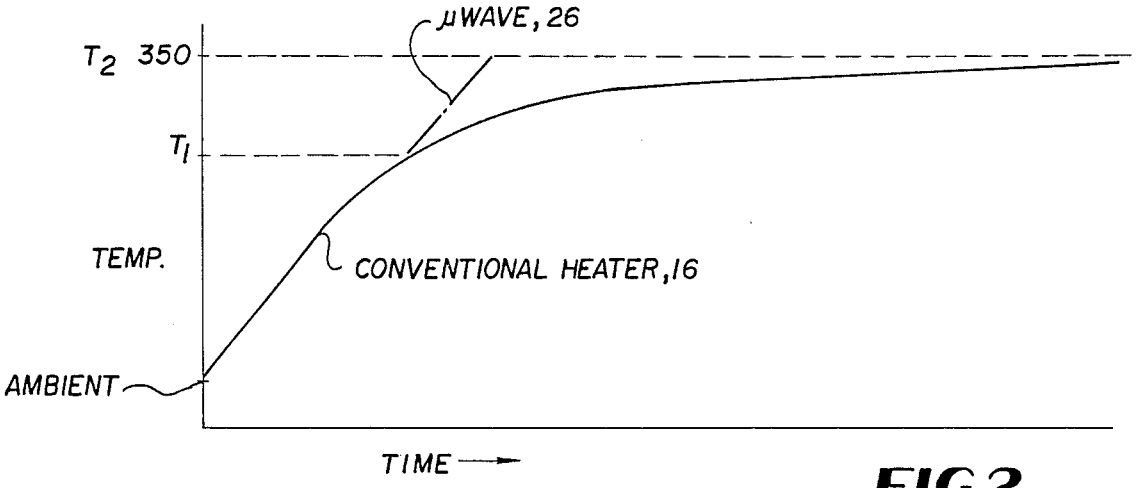
FIG. 2 shows in graphical form the way in which microwave heating and conventional heating are combined for maximum RAP treating efficiency.

In order to provide the most efficient and shortest time heating of the RAP material, it has been found that it is desirable to combine the relative economic advantages of a conventional heater or recirculating air dryer 16 with advantages which may be achieved from a microwave tunnel 26. In FIG. 2, there is shown in graphic form, the way the two heat sources may be combined to provide efficient and fast heating of the RAP to its desired temperature, 350° ($T_2$). Conventional heaters which have a gas temperature in excess of 350°to 400°, are capable of heating RAP at rapid rates, but they suffer the severe disadvantage of also producing degradation of asphaltic material with consequent smoke, and damage to the asphaltic materials. This is provided by the high heat which is in excess of the temperature that the asphalt can reasonably stand without damage. As shown in FIG. 2, the maximum temperature that the asphaltic material is usually raised to is the temperature $T_2$ or 350°. If a conventional heater is used to raise the RAP temperature from ambient to 350°, a very substantial period will be required because at the higher RAP temperatures, heat transfer to the RAP is very slow, and hence heat gain is very slow. Therefore, a substantial period of time will be required to raise the temperature of the RAP as the temperature approaches $T_2$. In order to avoid this limitation, this invention raises the temperature of the RAP by means of conventional heater only to a temperature $T_1$. Upon reaching temperature $T_1$, the material is removed from the conventional heater (16), and is passed through a microwave tunnel 26. Since the microwave heating is internal to the RAP and uniform, the rock temperature is rapidly raised to the desired temperature of 350°, but the exterior of the rock is not raised to temperatures in excess of 350°. By microwave heating, the rock material itself is raised in temperature while the asphaltic material on its surface is not affected by the microwaves. The asphaltic surface then absorbs heat from the now heated rocks, and rises in temperature. In this way, the temperature of the asphaltic material is prevented from exceeding 350°, while the RAP material is heated to the desired 350° in a rapid and efficient manner.

The RAP on departing the air recirculating air dryer 16 is at a temperature $T_1$. The RAP at this point in the process, however, may not be of a uniform temperature since the interior of larger particles will be much cooler than the exterior of the particles. For this reason, it may be necessary to provide a holding area 24 for allowing time for the heat to spread through the particles and provide a more uniform temperature. The holding area 24 may be a bin/feeder, or merely a long stretch of conveyor which provides the time lag necessary for even heat distribution. The temperature $T_1'$ indicates the temperature of the RAP which has now achieved a more uniform distribution by having passed through the holding area 14. This is also known as the mass average temperature of the RAP.

The RAP at temperature $T_1'$ is then fed to a microwave tunnel heater 26. In the microwave tunnel heater, the RAP is raised to a temperature of approximately 300° to 350°. In the microwave tunnel, the microwaves heat the rock, but do not directly heat the bituminous materials in the RAP. By heating the rock, the bituminous materials are also heated by conduction. The RAP in the microwave tunnel at higher temperatures may emit some vapor and smoke laden gas. This gaseous material is continuously removed from the microwave tunnel by the injection of $air_2$ into the tunnel. The $air_2$ is of a low velocity, but sufficient to remove the excess of build-up of gas and smoke in the tunnel. This removal is necessary so that conditions do not develop which will cause shorting and arcing within the tunnel.

The gases (28) removed from the tunnel may then be supplied to the burner section 22 of the recirculating air dryer 16. These exhaust gases contain hydrocarbon materials which may contribute to the combustion process, and are also at a high temperature so that heat is provided to the recirculating air dryer 16.

The RAP on departing the microwave tunnel 26 is at a temperature $T_2$ is on the order of 300° to 350°. The limit on the temperature of the RAP departing the microwave tunnel is also a function of the temperature at which the RAP experiences degradation of the bituminous compounds, and the generation of excess smoke.

The microwave tunnel 26 may be constructed as shown in FIG. 4. It has been found that the RAP material when passing within three inches or less of the magnetrons 52 (microwave applicators (antennae)) which is more efficient than merely relying upon microwave radiation, which is applied from a greater distance. With a coupled load, much less radiation is available for losses in other areas of the microwave heating tunnel. Still further, placement of the RAP close to the magnetrons prevents cross talk between magnetron units. It has been found that three inches or less is a desirable separation between the magnetrons and the RAP material.

In addition to providing a small separation between the RAP and the magnetrons 52, it has also been found that placement of a fiberglass blanket between the magnetrons 52 and the RAP will provide a barrier to smoke, and dust which may arise from the RAP material. In this way, the smoke and dust does not cause distortions in the microwave field and consequent arcing or generation of flame in the area of the conveyed RAP. As illustrated in FIG. 5, the fiberglass blanket 54 may be in the form of a continuously moving belt of fiberglass material placed above the RAP. By moving the belt at the same speed as the passing RAP, rubbing and other dust generation between the belt and RAP is eliminated. The top half of the rotating fiberglass belt may pass either below the applicator, or above the applicator. If the belt passes below the applicator, yet a further layer is provided which deters the passage of dust and/or vapor from the RAP material to the antenna/applicator. By the use of the fiberglass 54, the tendency of the microwave oven to arc and flame can be substantially reduced.

The microwave tunnel 26 is also preferably built of aluminum or stainless steel 50 which does not absorb or allow exchange of the microwave radiation. Similarly, the conveyor belt 56 is constructed with stainless steel which does not react with the microwave energy to any substantial degree. The edges 58 should also be at a right angle to the conveyor belt in order to prevent arcing. It is important that the edges 58 of the moving metal belt be kept at the bottom of the material being heated and that the edges be adjacent to the corner at the bottom of the tunnel frame. This also tends to put the edge of the moving belt in a location that will prevent arcing.

As can be seen in the end view of the microwave tunnel as depicted in FIG. 5, the belt is also preferably provided with a flexible material that is transparent to microwave fabric edged material (which may be fiberglass). This edge fabric material may be either self-supporting, or it may be supported in such a position that it retards the loss of RAP material from the belt as it passes through the microwave tunnel. The fabric edges may be constructed of fiberglass.

A mixing mill and storage container 30 receives the RAP at temperature $T_2$ from the microwave tunnel 26. This mill may be an auger screw-type, or a pug mill. The mill mixes the RAP with additional rejuvenating agents which are added to the RAP in order to provide a usable asphaltic paving compound. The rejuvenating agents may be bituminous compounds, rock, or any other material desired which will provide the proper specifications for the asphaltic concrete.

MOISTURE CONSIDERATIONS IN RAP TREATMENT PROCESS

It is known that substantially all of the moisture in milled RAP is found on the surface of the particles. Still further, proportionally more of the total moisture is on the surface of the small particles than on the large particles. This is due to the fact that the small particles have a much greater surface area per unit volume or weight than do the large particles.

Removal of the moisture through drying as in the prior art is expensive because it requires a large quantity of heat to vaporize the water, i.e., approximately 1000 BTU's per pound of water. Therefore, the step of sorting the fines out in the air sorter 14, reduces the total energy required by the process because it is no longer necessary to vaporize the water contained on the small particles or fines. The quality of the asphaltic concrete mixture is not damaged by removal of the small particles because these particles are mainly the result of the milling process and are not desirable in the final product.

A hot gas high speed air process of the type produced by the recirculating dryer 16 is generally a more economical way to evaporate moisture than by using microwave energy. The recirculating air dryer process evaporates the water and provides a dry preheated stream of RAP at temperature $T_1$ as the input for the microwave processor 26. In this manner, the least amount of energy possible is expended on removal of the water from the RAP.

In addition to giving an overall greater system efficiency, the water-free and fines-free asphalt fed to the microwave heater also enhances the microwave processing by eliminating vapor and dust which may lead to arcing within the microwave heater. This in turn reduces the danger of fire and explosion within the microwave tunnel. Also, microwave reflexion is reduced by the removal of these undesirable products.

Damage to magnetrons is also prevented by reduced arcing.

IMPROVED ASPHALTIC CONCRETE

It is well known that asphaltic cement materials give off visible smoke and are damaged to some extent when processed at a relatively high temperature. When the RAP is heated by hot gas streams in conventional heaters, the gas must be much higher than the desired temperature of the RAP ($T_2$), approximately 300° to 350°.

The temperature $T_2$ is in the range of 350°-300° F., the temperature necessary to provide proper lay down and compaction of the asphaltic material. High heat is necessary so that there will be rapid heat transfer from a hot gas into the RAP. This high heat at the RAP surface produces degradation of the bituminous compounds, excessive smoke, and gas which are a significant source of air pollutants, and which are undesirable in asphaltic pavement recycling conducted in urban areas.

Ideally, the surface and interior temperature of the RAP materials should not go above the desired output temperatures. In this way, smoking and degradation is substantially eliminated. By this process, the microwave provides heat to the rock portion of the RAP, but does not directly heat the asphalt. Therefore, the asphalt suffers no damage when the RAP is brought to the desired temperature in the microwave section.

APPARATUS USED

An air sorter is used because it will provide for effective separation of particles with low wear and simple mechanical systems. In contrast, normal mechanical cleaners such as screens are ineffective for removing fine particles in the RAP because the RAP tends to stick to the screens and clog them.

The air dryer preferably uses an air impingement method which provides improved efficiency in the air dryer. In the air dryer, air is forced into a thin layer of RAP lying on the conveyor by the use of small diameter tubes which inject air at a high velocity (100 mph). By high velocity hot air injection, the hot air molecules are placed in close proximity to the surface of the RAP particles. This reduces the insulating nature of the stationary air layers which exist at the particle boundary. The particle boundary layer removal (impingement) provides significant advantages over the normal low air velocity and flow methods previously used in processing of asphaltic concrete.

The present invention may be embodied in other specific forms without departing from the specific or essential attributes thereof. Reference should be made to the appended claims rather than to the foregoing specification as indicating the scope of this invention. The scope of this invention also includes reasonable equivalence thereof.

What is claimed is:

1. A method for heating reclaimed asphaltic concrete paving comprising the following steps in combination:
   - placement of the reclaimed asphaltic pavement RAP in an impingement air sorter for removing fine particles which are smaller than a predetermined size;
   - a first heating step comprising heating the remaining asphaltic paving in a recirculating air dryer to a first predetermined temperature; and
   - a second heating step comprising heating said reclaimed asphaltic concrete in a microwave tunnel to a second predetermined temperature.

2. The method in accordance with claim 1 further including the step of holding the asphaltic concrete paving for a predetermined time after completion of said first heating step, and before commencing second said heating step.

3. The method in accordance with claim 2, wherein said predetermined period time is sufficient to allow said asphaltic concrete paving to achieve a substantially uniform temperature throughout.

4. The method in accordance with claim 1, further comprising the step of placing said asphaltic concrete paving in a bin/feeder prior to said placement in said air sorter.

5. A method in accordance with claim 1, further comprising the step of mixing said asphaltic concrete paving after said step of heating said asphaltic concrete paving to said second predetermined temperature.

6. The method in accordance with claim 5, further comprising the step of adding rejuvenating agents to said asphaltic concrete paving material during said mixing step.

7. A method in accordance with claim 1, further comprising the step of burning the said fine particles in a combustion burner associated with said recirculating air dryer.

8. A method in accordance with claim 1, further comprising the step of removing gas and vapor from said microwave tunnel.

9. The method in accordance with claim 8, further comprising the step of burning said gas vapor produced by said microwave tunnel in a burner in said recirculating air dryer.

10. The method in accordance with claim 8, further comprising the step of introducing fresh air into said recirculating air dryer.

11. The method in accordance with claim 8, further comprising the step of removing a portion of the air and water vapor from said recirculating air dryer.

12. The method in accordance with claim 1, wherein said predetermined size is less than 10 mesh.

13. The method in accordance with claim 1, wherein said first predetermined temperature is greater than 200° and less than 250°.

14. The method in accordance with claim 1, wherein said second predetermined temperature is between 250° and 350°.

15. The method in accordance with claim 14, wherein said second predetermined temperature is the mass average temperature.

16. The method in accordance with claim 14, wherein the temperature of the air in said recirculating dryer is between 350° and 450° F.

17. The method in accordance with claim 1, further comprising the step of separating said RAP material into a plurality of graded sizes, and the step of heating each of said graded sizes at a predetermined rate and time in said recirculating air dryer.

18. The method of claim 17, wherein said recirculating air dryer divided into zones which provide the hottest gases to the hottest material, and the gases when cooled by the hot material to the cooler material entering the heating unit.

19. The method of claim 1 wherein said impingement air sorter has an air velocity in the order of 100 mph.

20. The method of claim 1 wherein said air dryer uses high velocity air.

21. The method of claim 20 wherein said air dryer high velocity is in the order of 100 mph.

22. The method of claim 20 wherein said recirculating air dryer is at a temperature which is the maximum permissible where smoking of the RAP is not present.

23. The method of claim 22 wherein said recirculating air dryer has an air temperature in the order of 350°–400°.

24. The method of claim 1 wherein said material is moved by conveyor belt means.

25. The method of claim 24 wherein said conveyor belt means is made of stainless steel.

26. The method of claim 24 wherein said conveyor belt means is made of a rubber.

27. The method of claim 17 wherein said RAP material is separated into 3 (three) grated sizes prior to the step of heating.

28. The method of claim 27 wherein said sizes are in the order of $+\frac{3}{8}$, $\frac{3}{8}-\frac{1}{8}$, and $-\frac{3}{8}$.

29. The method of claim 1 wherein said recirculating air dryer has a plurality of drying regions.

30. The method of claim 29 wherein there are three regions having minimum temperatures in the order of 270°, 180°, and 120°.

31. The method in accordance with claim 1 wherein said recirculating air dryer uses an air impingement method.

32. The method of claim 31 wherein said air of said recirculating air dryer is forced into a thin layer of RAP lying on a conveyor belt.

33. The method of claim 1 wherein said recirculating air dryer includes small diameter tubes which inject into said RAP air at a high velocity in the order of 100 mph.

* * * * *